US011091244B2

(12) United States Patent
Reese et al.

(10) Patent No.: US 11,091,244 B2
(45) Date of Patent: Aug. 17, 2021

(54) MARINE VESSEL DEHUMIDIFICATION SYSTEM

(71) Applicant: RITEAIRE MARINE LLC, St. Petersburg, FL (US)

(72) Inventors: Theodore J. Reese, Ft. Myers, FL (US); Hector A. Escardo, St. Petersburg, FL (US)

(73) Assignee: RITEAIRE MARINE LLC, St. Petersburg, FL (US)

( * ) Notice: Subject to any disclaimer, the term of this patent is extended or adjusted under 35 U.S.C. 154(b) by 0 days.

(21) Appl. No.: 16/698,130

(22) Filed: Nov. 27, 2019

(65) Prior Publication Data

US 2020/0094935 A1 Mar. 26, 2020

Related U.S. Application Data

(63) Continuation-in-part of application No. 14/637,453, filed on Mar. 4, 2015.

(60) Provisional application No. 61/948,944, filed on Mar. 6, 2014.

(51) Int. Cl.
*F24F 3/14* (2006.01)
*B63J 2/04* (2006.01)

(52) U.S. Cl.
CPC .. *B63J 2/04* (2013.01); *F24F 3/14* (2013.01)

(58) Field of Classification Search
CPC .... F24F 3/14; F24F 2003/144; F24F 2203/02; F24F 11/0008; F24F 11/085
See application file for complete search history.

(56) References Cited

U.S. PATENT DOCUMENTS

| | | | | |
|---|---|---|---|---|
| 2,282,013 | A | 5/1942 | Wetzsteon | |
| 2,966,779 | A | 1/1961 | Lintern et al. | |
| 3,469,412 | A | 9/1969 | Giuffre | |
| 4,183,224 | A | 1/1980 | Rule et al. | |
| 4,487,034 | A | 12/1984 | Cronin et al. | |
| 4,582,123 | A | 4/1986 | Williams | |
| 4,838,190 | A | 6/1989 | Levander | |
| 4,928,750 | A * | 5/1990 | Nurczyk | F24D 19/1084 165/216 |
| 5,020,334 | A | 6/1991 | Wilkinson | |
| 5,325,676 | A | 7/1994 | Meckler | |
| 5,908,494 | A | 6/1999 | Ross et al. | |
| 7,798,418 | B1 | 9/2010 | Rudd | |
| 7,975,637 | B1 | 7/2011 | Nida | |
| 9,459,022 | B2 | 10/2016 | Krupp et al. | |
| 9,546,794 | B1 | 1/2017 | Carson et al. | |
| 9,696,059 | B2 | 7/2017 | Street et al. | |
| 2005/0087612 | A1 | 4/2005 | Fuller | |

(Continued)

*Primary Examiner* — Nelson J Nieves

(74) *Attorney, Agent, or Firm* — Barnes & Thornburg LLP

(57) ABSTRACT

A dehumidification system for a marine vessel includes a dehumidifier having a supply and return. The dehumidifier is supported in an interior space of the marine vessel, separated from the outside ambient environment. The supply provides dehumidifier to air through dedicated ducting to one or more locations throughout the vessel. The return includes dedicated ducting that draws air from a return grate located away from any doors on the vessel that are open directly to the outside ambient air. For example, the return grill is positioned in a space below deck. The dehumidification system includes a controller that is positioned near the return grate.

22 Claims, 7 Drawing Sheets

(56) References Cited

U.S. PATENT DOCUMENTS

| | | | | |
|---|---|---|---|---|
| 2005/0252229 | A1 | 11/2005 | Moratalla | |
| 2006/0156927 | A1 | 7/2006 | Udagawa et al. | |
| 2007/0062983 | A1 | 3/2007 | Barnett et al. | |
| 2008/0029611 | A1* | 2/2008 | Schnell | F24F 11/0008 236/44 C |
| 2008/0202138 | A1 | 8/2008 | Pabisz et al. | |
| 2009/0211274 | A1 | 8/2009 | Meng | |
| 2010/0178199 | A1 | 7/2010 | Schuman | |
| 2010/0240295 | A1* | 9/2010 | Akhtar | F24F 1/00075 454/262 |
| 2011/0185751 | A1 | 8/2011 | Carson et al. | |
| 2011/0230131 | A1 | 9/2011 | Gao et al. | |
| 2012/0071082 | A1 | 3/2012 | Karamanos | |
| 2012/0165991 | A1 | 6/2012 | Tian et al. | |
| 2012/0166041 | A1 | 6/2012 | Takehisa | |
| 2012/0168119 | A1 | 7/2012 | Dunnavant | |
| 2012/0253520 | A1 | 10/2012 | Sartain et al. | |
| 2013/0025313 | A1 | 1/2013 | Buzzi | |
| 2013/0134229 | A1 | 5/2013 | Jang et al. | |
| 2013/0298586 | A1 | 11/2013 | Hwang et al. | |
| 2014/0182372 | A1 | 7/2014 | Scott et al. | |
| 2014/0338883 | A1 | 11/2014 | Watanabe | |
| 2015/0300664 | A1 | 10/2015 | Nakayama et al. | |
| 2015/0300673 | A1 | 10/2015 | Dodds et al. | |
| 2015/0345819 | A1 | 12/2015 | Ostrovsky et al. | |

* cited by examiner

MARINE VESSEL DEHUMIDIFICATION SYSTEM

PRIORITY CLAIM

This application is a continuation-in-part of U.S. application Ser. No. 14/637,453, filed Mar. 4, 2015, which claims the benefit of U.S. Provisional Patent Application No. 61/948,944, filed Mar. 6, 2014, each of which are expressly incorporated by reference herein.

BACKGROUND

The present application is related to environmental control systems for marine vessels. More specifically, the present application is related to centralized dehumidification systems for marine vessels.

By their nature, marine vessels are operated in high humidity environments. This is especially true in larger recreational vessels such as yachts which exceed 50 feet in length. These vessels are operated in warmer climates often in a tropical environment. These climates are conducive to the growth of mold when excess moisture is present and temperatures are sufficiently high.

The conventional approach to controlling the environment inside of a marine vessel has been to implement air-conditioning systems that use a central system such as a chiller to cool water which is then transferred to the cabins to be used for cooling. In other system, an expansion refrigeration system using a refrigerant gas is used with air from the cabin being passed over an evaporator coil to cool the air. The use of traditional air conditioning to reduce the air temperature has the additional effect of creating cooled surfaces both in the cooled air delivery system and within the cabin of the vessel.

In regions where the relative humidity reaches 60 to 90%, an inrush of ambient atmospheric air from outside of the vessel includes significant moisture that, when mixed with the cold, conditioned air causes condensation on surfaces within the vessel. In addition, if air is moved too quickly over the cold air conditioning coils, some of the water vapor passes through the air-conditioning unit. This water vapor then has the opportunity to condense inside of the cold air conditioning ducts or on cold surfaces such as the grill that overlies the air-conditioning output.

SUMMARY

The present application discloses one or more of the features recited in the appended claims and/or the following features which alone or in any combination, may comprise patentable subject matter.

According to a first aspect of the present disclosure, a dehumidification system for a marine vessel comprises a first supply outlet positioned in a first cabin, a second supply outlet positioned in a second cabin, and a return inlet spaced apart from at least one of the first and second cabins. The dehumidification system also comprises a dehumidifier which draws air from the return inlet, removes moisture from the air, and discharges the air having reduced moisture to the first and second supply outlets, spaced apart from the first and second cabins. The dehumidification system still further comprises a controller operable to detect the relative humidity in at least one of the first and second cabins and to control operation of the dehumidifier to cause a dehumidifier to discharge air having reduced moisture to the supply outlets when the relative humidity exceeds a predetermined threshold.

In some embodiments, the first and second cabins are generally air tight to form conditioned environment independent of atmospheric ambient air.

In some embodiments, the dehumidifier comprises a drain which transfers water removed from the air conditioned environment to the atmospheric ambient air.

In some embodiments, at least a portion of the second cabin is positioned below the water line of the marine vessel and wherein the return inlet is positioned in the second cabin below the second supply outlet.

In some embodiments, the dehumidification system has a separate supply duct for transferring air having reduced moisture for each of the supply outlets.

In some embodiments, the dehumidification system has a separate return duct for transferring air from the return inlet to the dehumidifier.

In some embodiments, the ductwork for the dehumidification system is dedicated and independent of any other HVAC system on the vessel.

According to a second aspect of the present disclosure, a marine vessel comprises an interior space which is generally air tight so that the interior space is independent of ambient atmospheric air and at least one door that is selectively openable to permit a transfer of ambient atmospheric air into the interior space. The marine vessel also comprises an air-conditioning system having an air handler, a supply outlet, a return inlet, and dedicated air conditioning system ductwork between the supply outlet, return inlet, and the air handler. The marine vessel still further comprises a dehumidification system. The dehumidification system comprises a first dehumidification system supply outlet positioned in the interior space, and a first dehumidification supply duct that is independent of the dedicated air-conditioning system ductwork and having a first end coupled to the first dehumidification system supply outlet. The dehumidification system also comprises a first dehumidification system return inlet positioned in the interior space and a first dehumidification return duct that is independent of the dedicated air-conditioning system ductwork and having a first end coupled to the first dehumidification system return. The dehumidification system still further comprises a dehumidifier coupled to a second end of the first dehumidification supply duct and coupled to a second end of the dehumidification system return outlet, wherein the dehumidifier draws air from the dehumidification return duct, removes moisture from the air, and discharges the air having reduced moisture to the dehumidification supply duct.

In some embodiments, the dehumidification system further comprises a controller including a humidity sensor positioned adjacent the first dehumidification system return inlet, the controller operable to activate the dehumidifier if the moisture detected by the humidity sensor exceeds a threshold value.

In some embodiments, the air-conditioning system operates independently of the dehumidification system. Air chilled by the air-conditioning system may be passed through the dehumidification system independently of the air-conditioning system, the dehumidification system operable to remove water from the air to reduce the moisture of the chilled air and thereby control moisture within the marine vessel to reduce the opportunity for mold growth In some embodiments, the controller further includes a temperature sensor, the controller operable to compare the temperature detected by the temperature sensor with the humidity detected by the humidity sensor to determine the relative humidity and operate the dehumidification system based on the calculated relative humidity.

In some embodiments, the dehumidification system further comprises a second dehumidification system supply outlet positioned in the interior space and spaced apart from the first dehumidification supply outlet, a second dehumidification supply duct that is independent of the dedicated air-conditioning system ductwork and having a first end coupled to the second dehumidification system supply outlet, a second dehumidification system return inlet positioned in the interior space, and a second dehumidification return duct that is independent of the dedicated air-conditioning system ductwork and having a first end coupled to the second dehumidification system return.

In some embodiments, the dehumidification system further comprises a first controller including a first humidity sensor positioned adjacent the first dehumidification system return inlet, the controller operable to activate the dehumidifier if the moisture detected by the first humidity sensor exceeds a threshold value and a second controller including a second humidity sensor positioned adjacent the second dehumidification system return inlet, the second controller operable to activate the dehumidifier if the moisture detected by the second humidity sensor exceeds a threshold value.

In some embodiments, the dehumidification system includes a return plenum with having a first damper operable under the control of the first controller to vary the flow of air from the first dehumidification system return inlet and a second damper operable under the control of the second controller to vary the flow of air from the second dehumidification system return inlet.

In some embodiments, the dehumidification system includes a supply plenum with having a first damper operable under the control of the first controller to vary the flow of air to the first dehumidification system supply outlet and a second damper operable under the control of the second controller to vary the flow of air to the second dehumidification system supply outlet.

According to a third aspect of the present disclosure, a marine vessel comprises an interior space which is generally air tight so that the interior space is independent of ambient atmospheric air, at least one door that is selectively openable to permit a transfer of ambient atmospheric air into the interior space, and an air-conditioning system having an air handler, a supply outlet, a return inlet, and dedicated air conditioning system ductwork between the supply outlet, return inlet, and the air handler. The marine vessel further comprises a first dehumidification system and a second dehumidification system. The first dehumidification system includes first dehumidification system supply outlet positioned in the interior space, and a first dehumidification supply duct that is independent of the dedicated air-conditioning system ductwork and having a first end coupled to the first dehumidification system supply outlet. The first dehumidification system also includes a first dehumidification system return inlet positioned in the interior space, and a first dehumidification return duct that is independent of the dedicated air-conditioning system ductwork and having a first end coupled to the first dehumidification system return. The first dehumidification system still further includes a first dehumidifier coupled to a second end of the first dehumidification supply duct and coupled to a second end of the dehumidification system return outlet, wherein the dehumidifier draws air from the dehumidification return duct, removes moisture from the air, and discharges the air having reduced moisture to the first dehumidification supply duct. The second dehumidification system includes a second dehumidification system supply outlet positioned in the interior space, and a second dehumidification supply duct that is independent of the dedicated air-conditioning system ductwork and having a second end coupled to the second dehumidification system supply outlet. The second dehumidification system also includes a second dehumidification system return inlet positioned in the interior space, and a second dehumidification return duct that is independent of the dedicated air-conditioning system ductwork and having a second end coupled to the second dehumidification system return. The second dehumidification system still further includes a second dehumidifier coupled to a second end of the second dehumidification supply duct and coupled to a second end of the dehumidification system return outlet, wherein the dehumidifier draws air from the dehumidification return duct, removes moisture from the air, and discharges the air having reduced moisture to the dehumidification supply duct.

In some embodiments, the dehumidification system further comprises a first controller including a first humidity sensor positioned adjacent the first dehumidification system return inlet, the controller operable to activate the dehumidifier if the moisture detected by the first humidity sensor exceeds a threshold value and a second controller including a second humidity sensor positioned adjacent the second dehumidification system return inlet, the second controller operable to activate the dehumidifier if the moisture detected by the second humidity sensor exceeds a threshold value.

In some embodiments, the first dehumidification system supply outlet is positioned in a first cabin and the second dehumidification system supply outlet is positioned in a second cabin.

In some embodiments, the first dehumidification system return inlet is positioned in the first cabin and the second dehumidification system return inlet is positioned in the second cabin.

In some embodiments, the first controller is positioned in the first cabin and the second controller is positioned in the second cabin.

In some embodiments, the second dehumidification system comprises a third dehumidification system supply outlet positioned in a third cabin, and a third dehumidification supply duct that is independent of the dedicated air-conditioning system ductwork and having a second end coupled to the second dehumidification system supply outlet.

According to a fourth aspect of the present disclosure, a method of reducing volatiles in the air contained in an enclosed space of a marine vessel comprises drawing air from the enclosed space into an HVAC system, passing the air drawn into the HVAC system over a first chiller of the HVAC system to remove heat from the air, and circulating the chilled air through a dehumidification system that is independent of the HVAC system. The dehumidification system is operable to remove water from the air to reduce the moisture of the chilled air. Removal of the moisture effectively removes polar molecules of volatiles that bond to the molecules of water in the form of water vapor in the air, thereby reducing the relative humidity in the enclosed space to remove at least some of the water molecules in the enclosed space. The method further includes discharging the moisture removed from the chilled air from the enclosed space to remove the polar molecules bonded to the molecules of water from the enclosed space.

In some embodiments, the enclosed space comprises an interior of a marine vessel. In some embodiments, discharging the moisture includes discharging the moisture from the marine vessel by discharging the moisture overboard.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
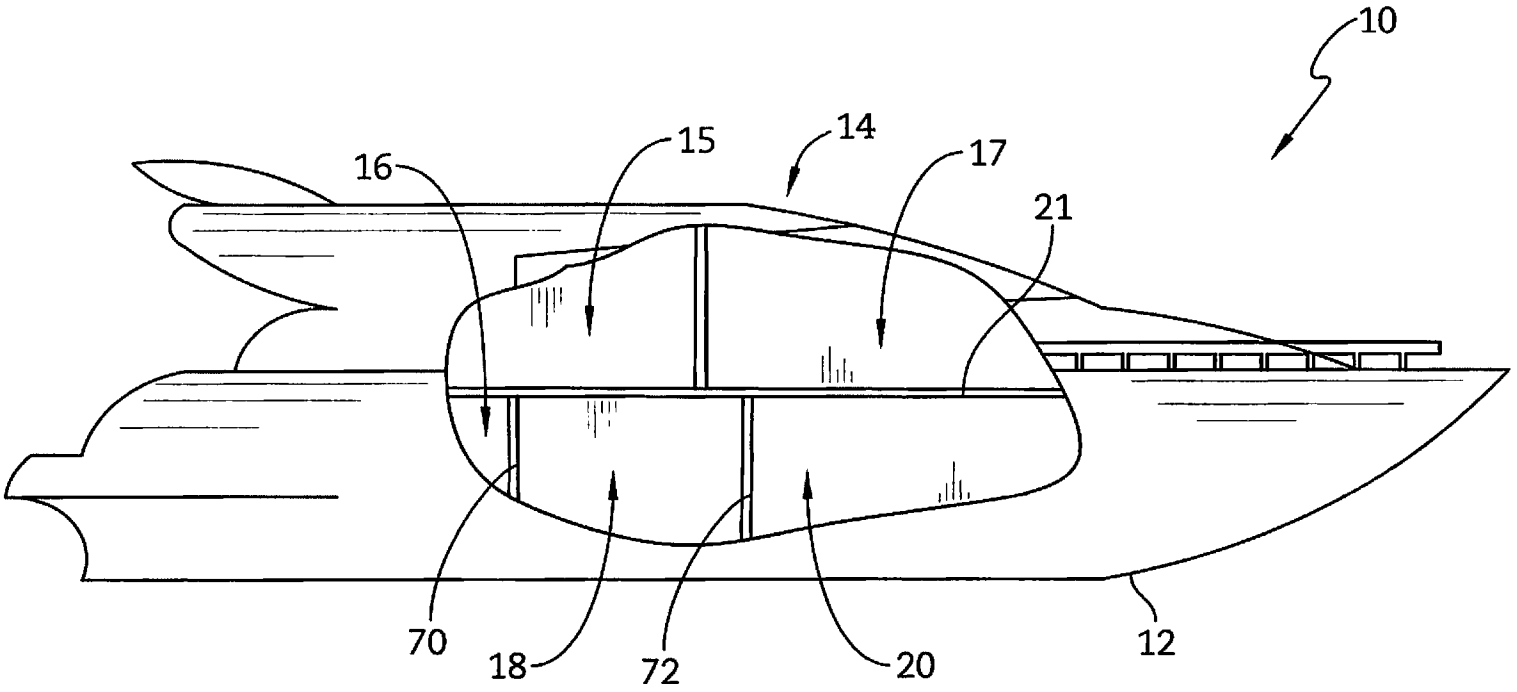
FIG. 1 is a plan view of a marine vessel having portions cut-away to show that the interior space includes multiple spaces separated by bulkheads and other structures.

A marine vessel or yacht 10 includes a hull 12 and an upper cabin 14 as shown in FIG. 1. In the illustrative embodiment of FIG. 1, the upper cabin 14 includes a living space 15 and a bridge 17. Illustratively, there are two state rooms 18 and 20 below the deck 21. In addition, an engine room 16 is also positioned below deck 21. As will be discussed in further detail below, the engine room 16 is separated from the rear stateroom 18 by a bulkhead 70. The forward stateroom 20 is separated from the rear stateroom 18 by another bulkhead 72. In the illustrative embodiment, the upper cabin 14 and staterooms 18 and 20 below deck are all generally sealed relative to the ambient outside air. In addition, each of the staterooms 18 and 20, and the upper cabin 14 may be selectively sealed via respective hatches (not shown) to provide privacy in each of the spaces.

Figure 2:
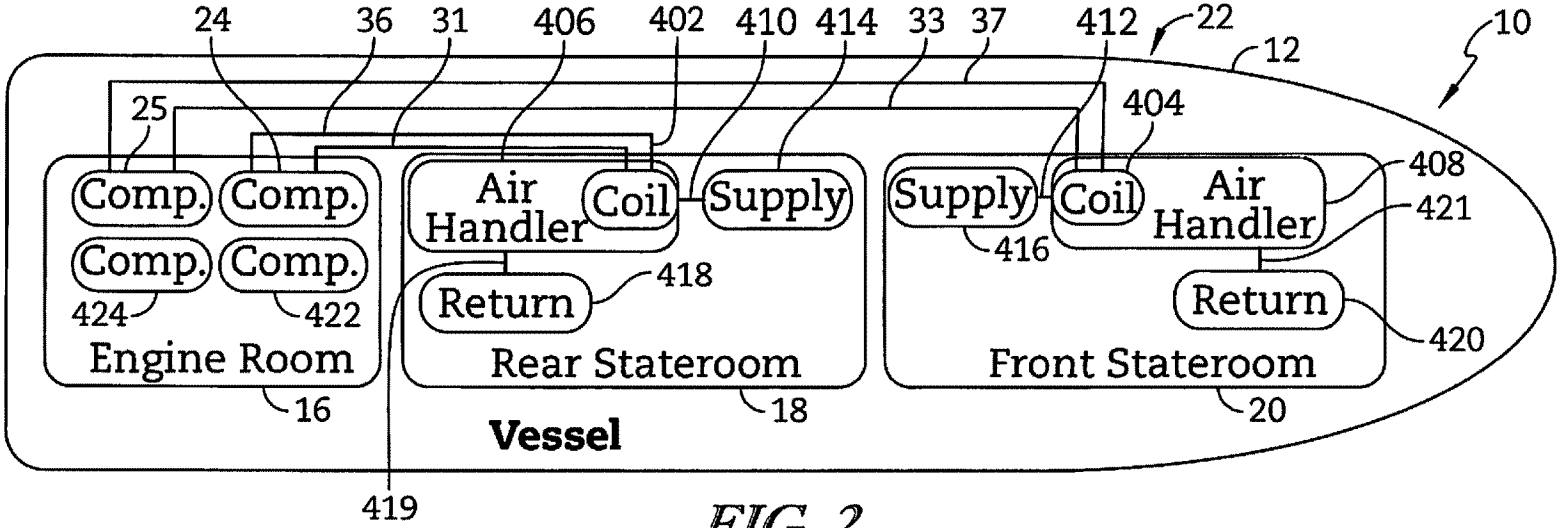
FIG. 2 is a diagrammatic representation of an air conditioning system for a portion of a marine vessel, such as the vessel shown in FIG. 1.

As illustrated in FIG. 2, the vessel 10 includes an air-conditioning system 22 which includes a first compressor 24 which is dedicated to compressing a refrigerant gas that is used to air-condition the rear stateroom 18 and a second compressor 25 which is dedicated to compressing a refrigerant gas that is used to air-condition the forward stateroom 20. The compressors 24, 25 are in the unconditioned space of the engine room 16. The first compressor 24 has a supply line 31 that feeds refrigerated gas to an air handler 406 that includes an evaporator coil 402 and is positioned in the wall of the stateroom 18. A return line 36 returns the expanded refrigerant 24 to the compressor 24. The second compressor 25 supplies condensed refrigerant through a supply line 33 to an air handler 408 that includes an evaporator coil 404. The expanded refrigerant is returned through a return line 37 to the compressor 25. In each stateroom 18, 20 the respective air handlers 406, 408 move air over the respective coils 402 and 404. The air is cooled by the coils 402 and 404 as heat is absorbed by the refrigerant to expand the refrigerant and supplied to the stateroom through a respective duct 410, 412 to supply outlet 414 or 416 which delivers the conditioned air to the living space of the staterooms 18 and 20. Each stateroom 18, 20 has a respective return inlet 418, 420 which have associated ducts 419 and 421 through which air is drawn into the air handlers 406, 408 to circulate the cool air through the staterooms 18 and 20.

Figure 3:
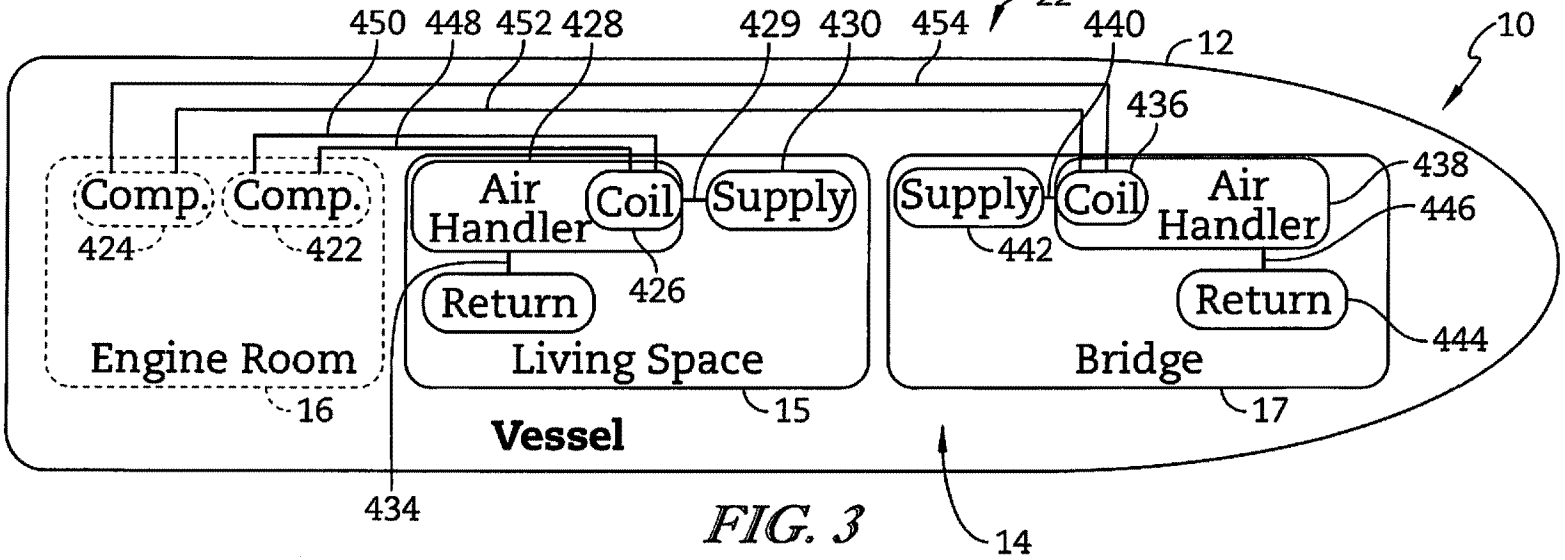
FIG. 3 is a diagrammatic representation of an air conditioning system for another portion of a marine vessel, such as the vessel shown in FIG. 1.

Referring now to FIG. 3, the living space 15 and bridge 17 are each also conditioned by the air-conditioning system 22. A third compressor 422 and fourth compressor 424, shown in phantom in the engine room 16 which is below deck, are dedicated to the respective living space 15 and bridge 17. The upper cabin 14 has an air handler 428 with an evaporator coil 426. The air handler 428 pushes air over the coil 426 through a duct 429 to a supply outlet 430. A return inlet 432 is positioned in the living space 15, spaced apart from the supply outlet 430. Conditioned air circulates through the living space 15 from the supply outlet 430 to the return inlet 432 which feeds the air handler 428 through a duct 434. Similarly, the bridge 17 includes an air handler 438 with an evaporator coil 436. The air handler 438 pushes air over the coil 436 through a duct 440 to a supply outlet 442. A return inlet 444 is positioned in the bridge 17, spaced apart from the supply outlet 442. Conditioned air circulates through the bridge 17 from the supply outlet 442 to the return inlet 444 which feeds the air handler 438 through a duct 446.

The compressor 422 feeds refrigerant to the coil 426 through a supply line 448 and the refrigerant is returned to the compressor 422 through a return line 450. Similarly, the compressor 424 feeds refrigerant to the coil 436 through a supply line 452 and the refrigerant returns to the compressor 424 through a return line 454.

The compressors 24, 25, 422, and 424 are each in electrical communication with their respective air handler 406, 408, 428, 438 and a respective controller for each (not shown). The controller causes the air handler and respective compressor to turn on when the air temperature rises above a predetermined set point as is well known in the art.

In some embodiments, the compressors are replaced by a single chiller that has a complete refrigerant circuit. In such an embodiment, the chiller utilizes a closed loop water system that feeds a standard radiator coil over which cold air is blown by an air handler. In such a system, the heat gathered by the cooled water is absorbed by sea water that is drawn in over a heat exchanger and discharged outside the vessel 10. In still other embodiments, there may be a dedicated compressor at each air handler so that the heat is dissipated in unconditioned space near the air-conditioned space. In each embodiment, the air conditioning arrangement has dedicated ducting in each conditioned area.

Figure 4:
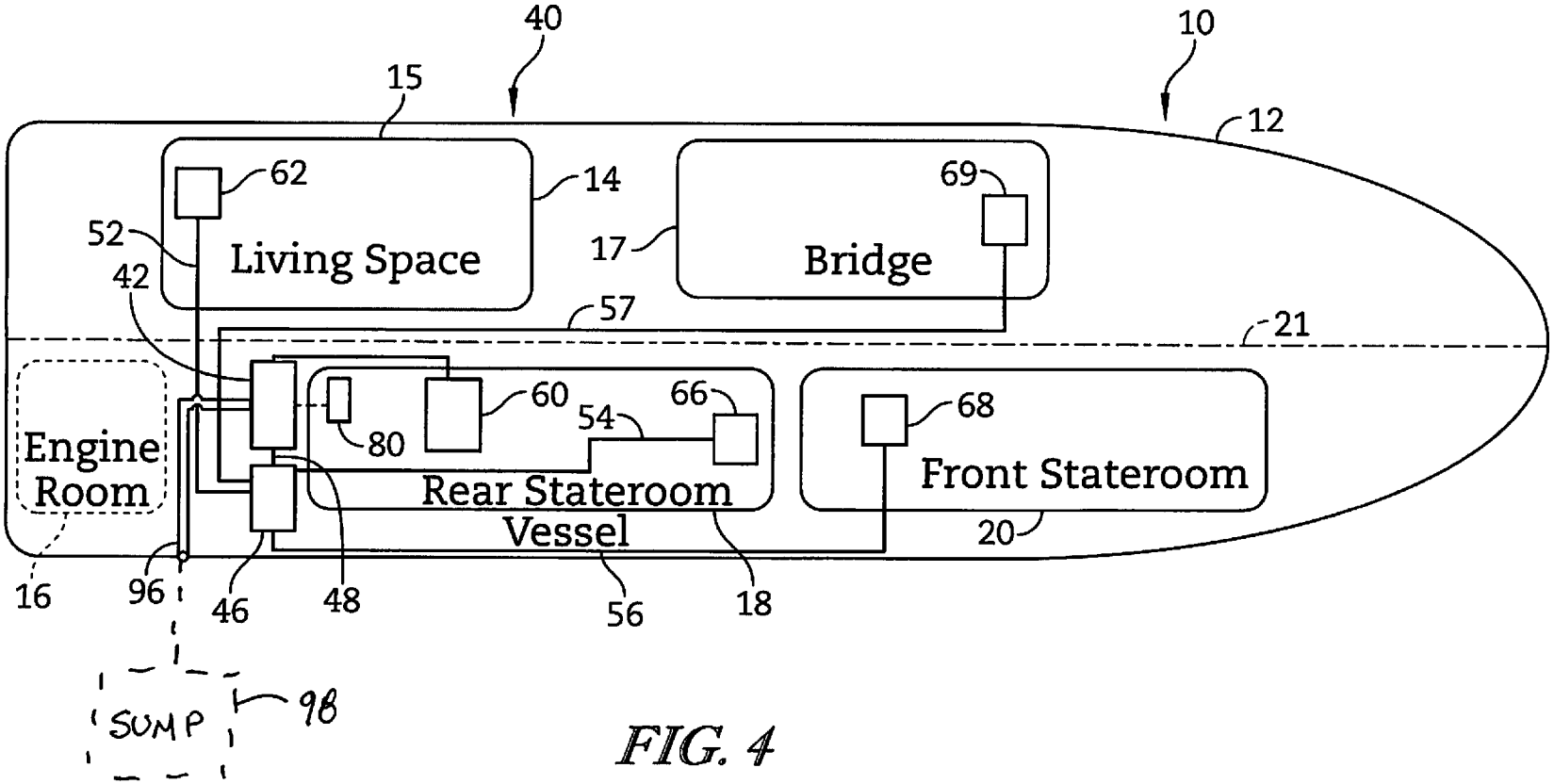
FIG. 4 is a diagrammatic representation of the implementation of the dehumidification system of the present disclosure on an illustrative vessel, such as the vessel shown in FIG. 1.

Referring now to FIG. 4, the vessel 10 of the illustrative embodiment includes a dehumidification system 40 which includes a dehumidifier 42 which is positioned in the bulkhead 70. The dehumidifier 42 may be placed in any non-conditioned space that provides sufficient room for the dehumidifier 42 and access to route ducting. The dehumidification system 40 further includes a manifold 46 that is fed by a supply 48 from the dehumidifier 42 and which in turn feeds four dehumidification supply ducts 52, 54, 56, and 57. The dehumidification system supply duct 52 feeds a supply outlet 62 in the upper cabin 14. The dehumidification system supply duct 54 feeds a supply outlet 66 in the rear stateroom 18. The dehumidification system supply duct 56 feeds a supply outlet 68 positioned in the forward stateroom 20. The supply duct 57 feeds a supply outlet 69 positioned in the bridge 17.

The dehumidification system 40 also includes a return 50 which is connected to a return duct 58 and draws return air through a return register 60 positioned in the rear stateroom 18. The dehumidification system 40 including the associated ducting is independent of the air-conditioning system 22. The dehumidification system 40 includes a drain 96 which transfers water removed by the dehumidifier 42 through the hull 12 and overboard. In some embodiments, the drain 96 is not directed to discharge the water overboard, but may be discharged into a sump or a gray water tank 98 and re-used for other uses that do not require potable water on board the vessel 10. When the water is discharged to a sump 98, a separate sump pump may be used to occasionally discharge the water overboard.

While the illustrative embodiment shows only an air-conditioning system 22, it should be understood that the air-conditioning system 22 may also include a heat source configured to heat air to warm various areas of the interior of the vessel 10. According to the present disclosure, the dehumidification system 40 is independent of any HVAC system, such as the air-conditioning system 22, and utilizes separate ductwork and controls to address humidity within the interior of the vessel 10. The separation of the dehumidification system 40 and the associated ducting from the HVAC systems has been found to improve the performance of both the HVAC system and the dehumidification system 40. In a further embodiment, the dehumidification system 40 removes moisture from the air and supplies the dehumidified air to the HVAC system. The HVAC system independently cools the air and supplies the dehumidified and cooled air to the cabin. Reduction of the moisture in the air before it is treated by the HVAC system prevents unexpected condensation throughout the HVAC system and improves the efficiency of the HVAC system. In addition, air chilled by a chiller of the HVAC system is passed through the dehumidification system independently of the air-conditioning system, the dehumidification system operable to remove water from the air to reduce the moisture of the chilled air and thereby control moisture within the marine vessel to reduce the opportunity for mold growth.

Figure 5:
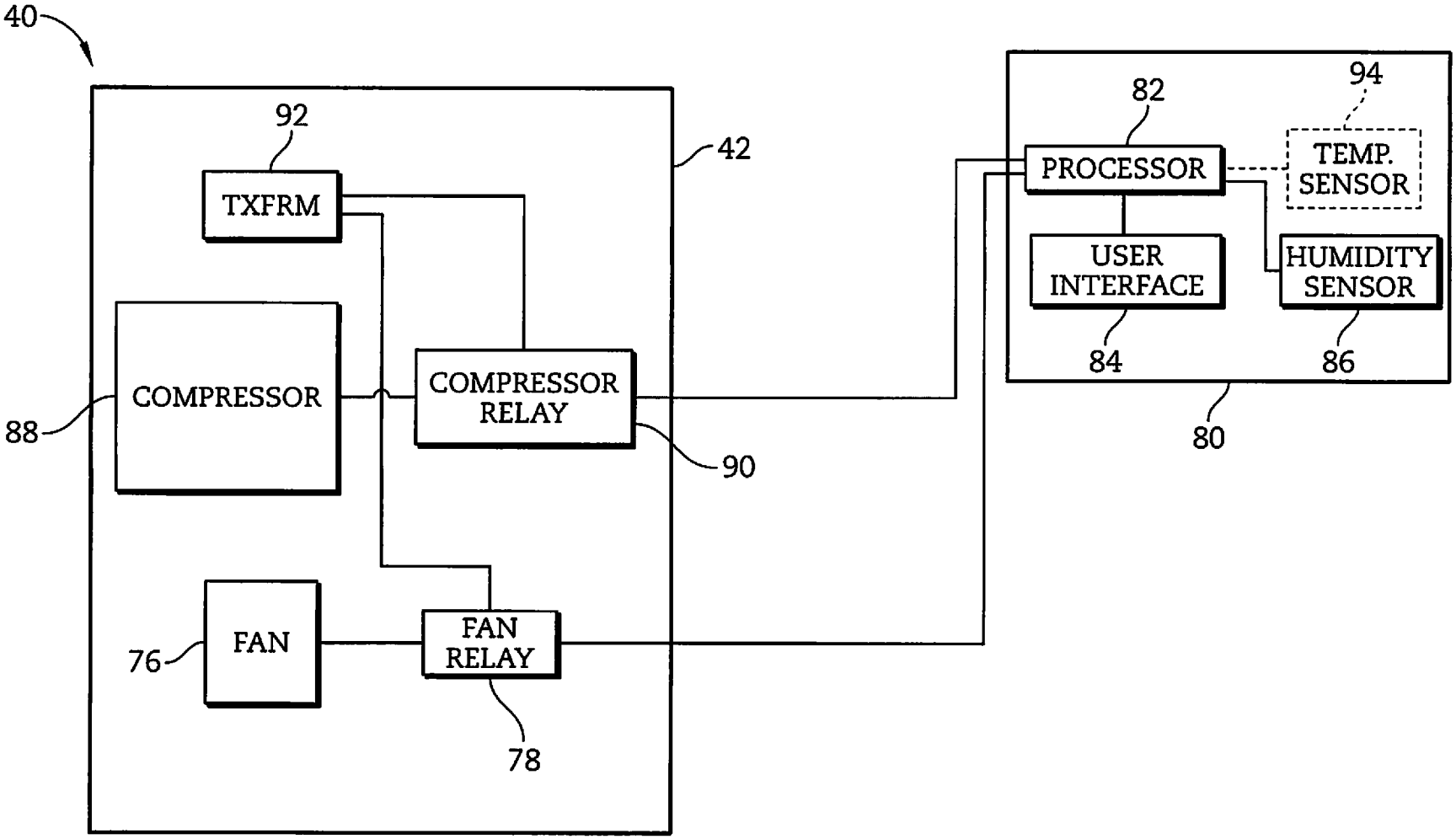
FIG. 5 is a schematic diagram of the electrical system of the dehumidification system of FIG. 3.

Referring now to FIG. 5, the electrical schematic of the dehumidification system 40 is shown as a block diagram. The dehumidifier 42 of the illustrative embodiment includes a fan 76 that is selectively operable to cause air to be moved from the return register 60 through the dehumidifier 42 and back into the supply 48. The fan 76 is activated by a fan relay 78 under the control of a dehumidification controller 80. The dehumidification controller 80 includes a processor 82, a user interface 84, and a humidity sensor 86. In a typical installation, the dehumidification controller 80 is positioned near the dehumidification return register 60 as shown in FIG. 4. The dehumidifier 42 also includes a compressor 88 and a compressor relay 90 which activates the compressor under the control of the dehumidification controller 80. The dehumidifier 42 also includes a transformer 92 which receives power from the main power supply of the vessel 10 and converts the power as appropriate to control the components of the dehumidification system 40. In some embodiments, the dehumidification controller 80 may further include a temperature sensor 94 which may be input to the processor 82 in combination with the humidity sensor 86 to modify the operation of the dehumidifier 42 based on the combination of the humidity and temperature sensed by the sensors 86 and 94 respectively.

Figure 6:
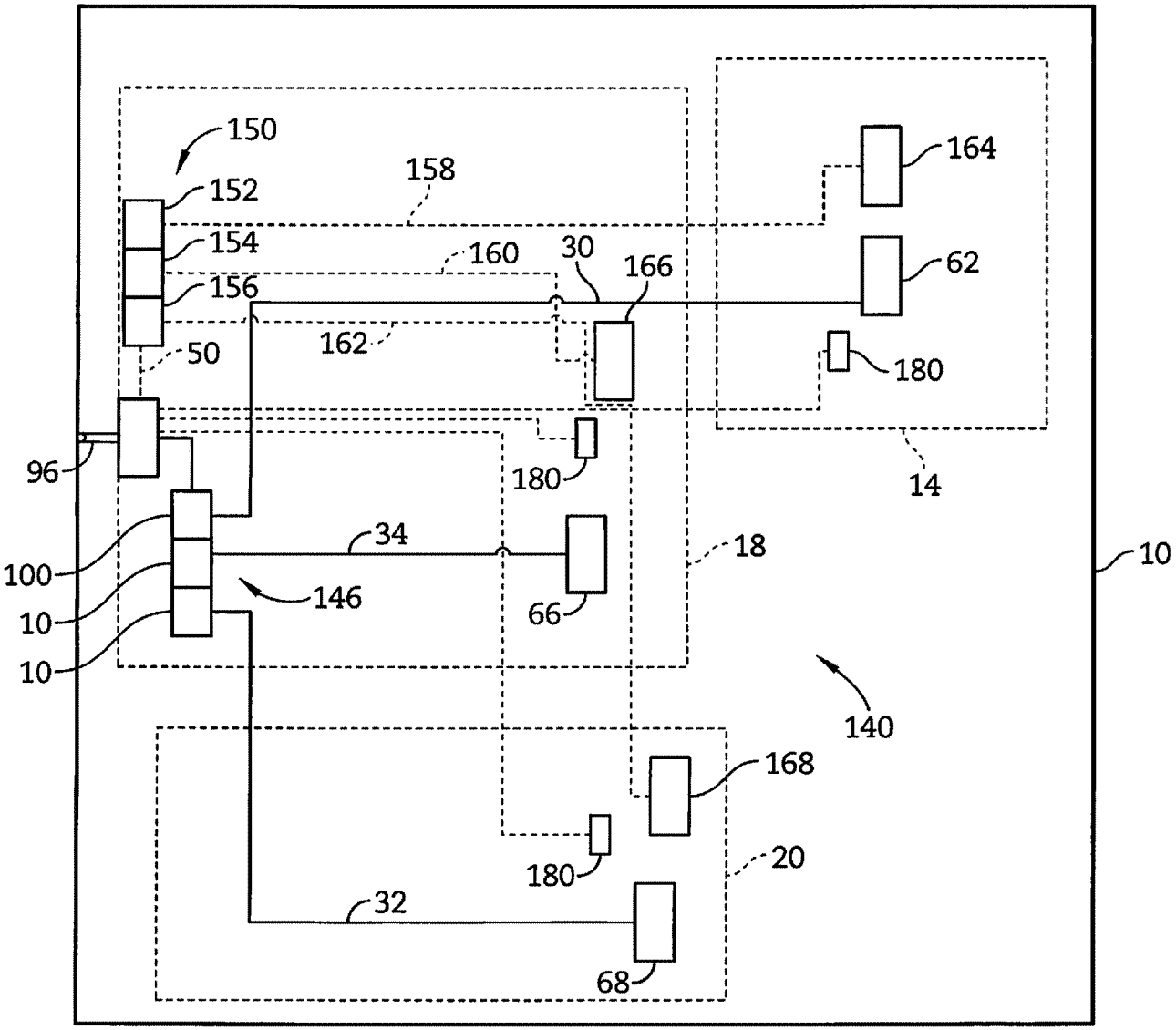
FIG. 6 is a diagrammatic representation of another embodiment of a dehumidification system for a marine vessel.

In an another embodiment, shown in FIG. 6, a vessel 210 includes a dehumidification system 140 that is similar to the dehumidification system 40, with the manifold 46 being replaced with a damper controlled plenum 146 that selectively controls the flow of supply air from the supply 48 to each of the supply ducts 30, 32, and 34. In the embodiment of FIG. 6, the plenum 146 includes a separate damper 100, 102, and 104 for each of the supply ducts 30, 32, and 34 respectively. There is a separate dehumidification controller 180 positioned in each stateroom 18 and 20 as well as one in the upper cabin 14. Each dehumidification controller 180 provides input to the dehumidifier 42 and the respective damper 100, 102, and 104, so as to control the humidity in each of the staterooms 18, 20 and upper cabin 14 independently. To that end, the return 50 includes a plenum 150 with a separate damper 152, 154, and 156. Each damper is connected to a respective return duct 158, 160, and 162. Each return duct 158, 160, 162 is connected to a respective return register 164, 166, and 168 positioned in the upper cabin 14, rear stateroom 18, and forward stateroom 20, respectively. Thus, each dehumidification controller 180 is operable to control operation of the dehumidifier 42 and the respective dampers in both the supply plenum 146 and the return plenum 150. This permits tailored control in each of the upper cabin 14, rear stateroom 18, and forward stateroom 20, respectively.

Figure 7:
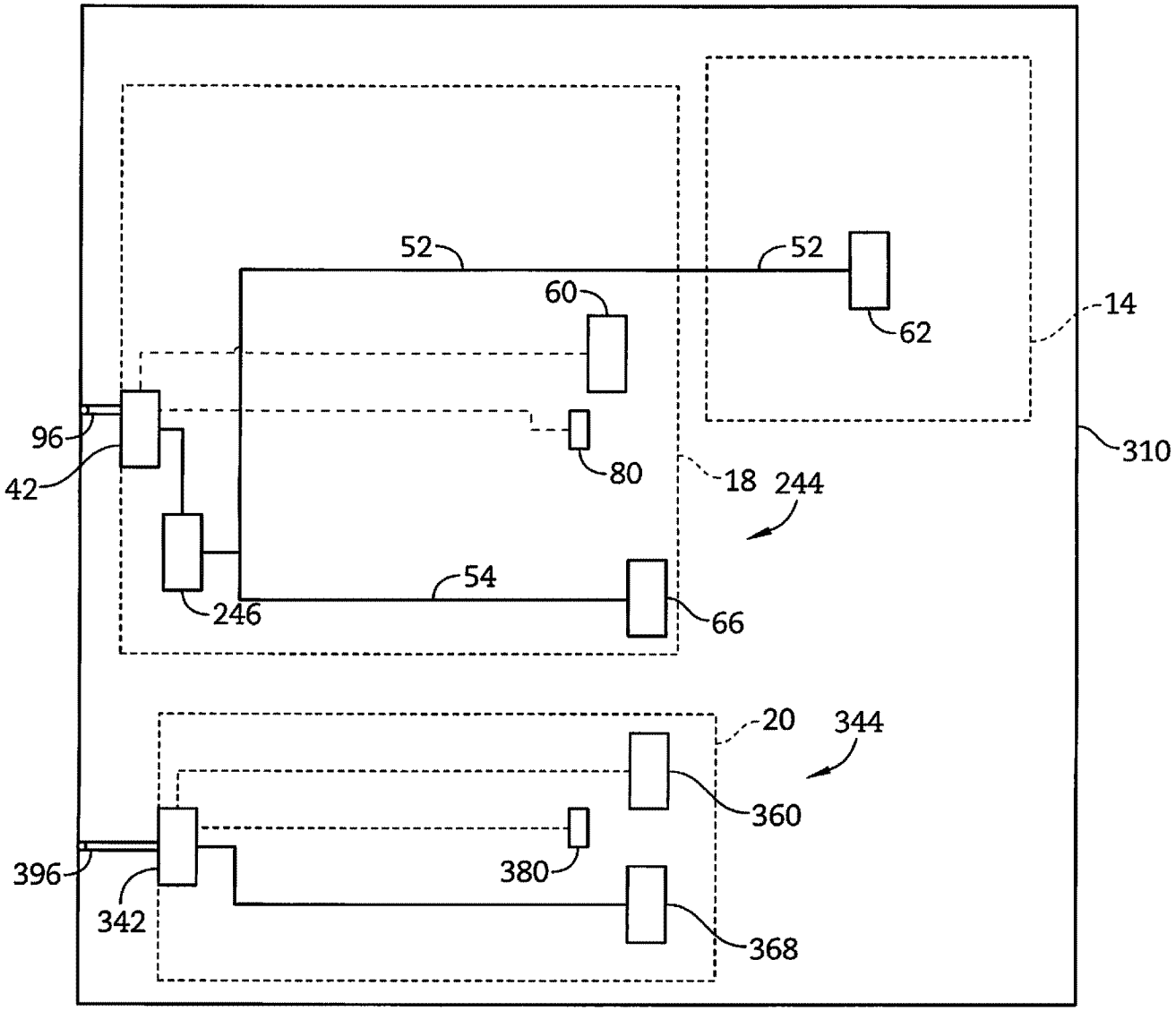
FIG. 7 is a diagrammatic representation of yet another embodiment that includes multiple dehumidification systems installed on a single vessel.

Referring now to FIG. 7, still another embodiment shows a vessel 310 that includes a first dehumidification system 244 and a second dehumidification system 344. The primary difference between the embodiment of FIG. 7 and the embodiments discussed above is the presences of two separate dehumidification systems. The first dehumidification system 244 is similar to the humidification system 44 with the elements related to the forward stateroom 20 omitted. The manifold 246 replaces manifold 46 and only branches to the two supply ducts 52 and 54. The second dehumidification system 344 is dedicated to the stateroom 20 and includes separate dehumidifier 342 with a separate drain 396. The dehumidifier 342 has a single supply that feeds a supply duct 356 which outputs to a supply outlet 368. A single return duct 352 draws air from a return register 360 positioned in the forward stateroom 20. A dedicated dehumidification system controller 380 is structured similarly to the dehumidification controller 80. Thus, the second dehumidification system 344 is dedicated to controlling the humidity in the forward stateroom 20.

Figure 8:
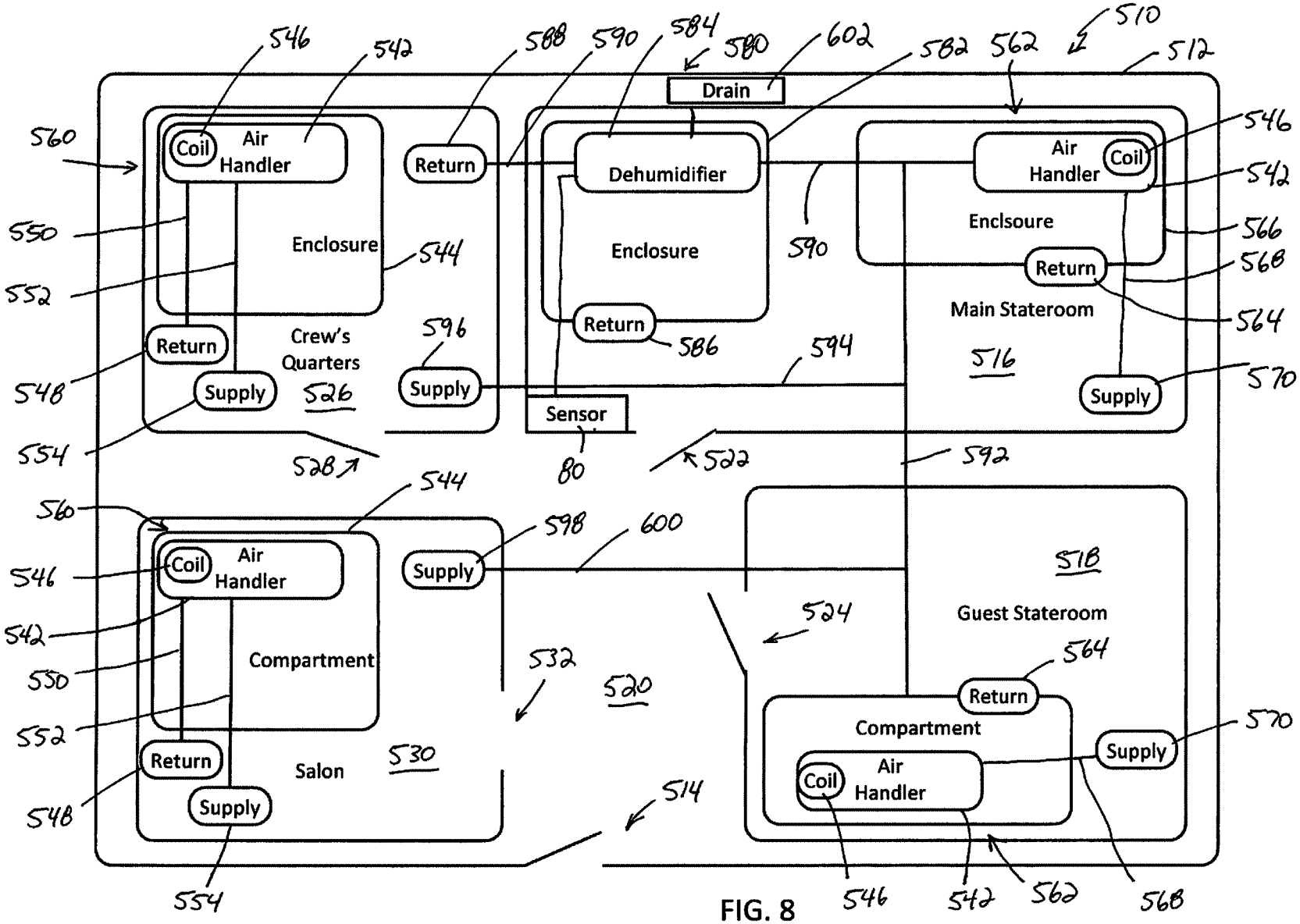
FIG. 8 is a diagrammatic representation of another yet another embodiment that includes a dehumidification system with alternative delivery routes of dehumidified air.

In another embodiment shown in FIG. 8, a portion of a marine vessel 510 is shown with an enclosed space 512 that includes a number of compartments or spaces that are occupied by individuals associated with the marine vessel 510. The enclosed space 512 is accessed from ambient air by a door 514 which allows individuals to enter into a common space 520. In addition, a main stateroom 516 is a compartmentalized space that is generally used by the owner or chief occupant of the marine vessel 510 as a living space and may also function as a bedroom. The main stateroom 516 is accessible through a door 522 which separates the internal space of the main stateroom 516 from common space 520, the door 522 being movable between an open position and a closed position such that when the door 522 is open, air can flow between the internal space of the main stateroom 516 and the common space 520.

A guest stateroom 518 is also positioned in the enclosed space 512 and is separated from the common space 520 by a door 524 that is also movable between an open position and a closed position such that when the door 524 is open, air can flow between the internal space of the guest stateroom 518 and the common space 520. The doors 522 and 524 each allow the respective staterooms 516 and 518 to be closed for privacy for the occupants.

A crew's quarters 526 is also positioned in the enclosed space 512 and separated by a door 528 that is movable between an open position and a closed position such that when the door 528 is open, air can flow between the internal space of the crew's quarters 526 and the common space 520.

Yet another compartment, illustratively shown as a salon 530, functions as a common space for occupants and guests of the marine vessel 510. In other embodiments, the compartment 530 may be embodied as a galley, a bridge, or any other common area. In the present disclosure, the salon 530 is generally enclosed, but includes an opening 532 that allows air to flow freely between the salon 530 and the common space 520.

In the illustrative embodiment of FIG. 9, each of the internal compartments 516, 518, 526, and 530 have an independent air conditioning system 560 that is dedicated to that particular compartment, the common space 520 being managed by the combination of the compartments 516, 518, and 526 indirectly and the salon 530 directly. In the salon 530 and crew quarters 526, the air conditioning system 540 is of a similar construction and like components in each are referred to with the same reference number. The air conditioning system 540 includes an air handler 542 positioned in a separate enclosure 544. A coil 546 is positioned in communication with the air handler 542 so that air flows from a return inlet 548 through a return duct 550 over the coil 546 and is exhausted through a supply duct 552 to a supply outlet 554. The coil 546 receives chilled water from a central chiller in a manner described above. In other embodiments, the coil 546 may be a portion of a refrigeration circuit contained within the enclosure 544.

The master stateroom 516 and guest stateroom 518 have another configuration of air conditioning system 562. Notably, the air conditioning system 562 does not have a return duct, but a return vent 564 is positioned on the wall of an enclosure 566 so that the air handler 542 is fed by air that enters the enclosure 566 through the return vent 564. The air is then processed by the air handler 542, passing the air over the coil 546 and feeding the air conditioned air to the respective staterooms 516 and 518 by supply duct 568 that feeds a supply outlet 570 that is positioned away from the enclosure 566. The use of the return inlet 564 on the enclosure 566 eliminates the need for return ducting that may be difficult to position in certain configurations of marine vessels.

Each of the compartments 516, 518, 528, and 530 are serviced by a single dehumidification system 580. The illustrative dehumidification system 580 includes a dehumidifier 584 positioned in an enclosure 582 positioned in the main stateroom 516. They dehumidification receives return air and supplies supply air to each of the compartments 516, 518, 526, and 530 differently. FIG. 9 illustrates various approaches that may be employed in a marine vessel and each variant described herein may be employed in combination with the other described variants as the particular configuration of a marine vessel and installation limitations dictates.

In the main stateroom 516, the dehumidification system 580 includes a return inlet 586 positioned on a wall of the enclosure 582. Air is drawn through the return inlet 586 to the dehumidifier 584 by an air mover that is internal to the dehumidifier 584. The air is dehumidified by the dehumidifier 584 and fed to a main supply duct 590 which feeds the air handler 542 of the air conditioning system 562 positioned in the enclosure 566. The supply duct 590 feeds the air handler 542 directly with the duct 590 engaged with the air handler 542. The dehumidified air is then fed through the supply duct 568 of the air conditioning system 562 to the supply outlet 570 positioned in the main stateroom 516. It should be understood that if the air conditioning system 562 is not operating, the dry air provided by supply duct 590 continues to be fed to the main stateroom 516 as it may flow through the air handler 542, supply duct 568, and exit the supply outlet 570 into the main space of the main stateroom 516.

The main supply duct 590 is engaged by a branch supply duct 592 which directs dehumidified air to the enclosure 566 of the air conditioning system 562 of the guest stateroom 518. The air enters the enclosure 566 and mixes with the air being drawn from the guest stateroom by the air handler 542 through the return inlet 564. The resulting mixed air is then processed by the air conditioning system 562 and returned to the guest stateroom 518 through the supply duct 568 and supply outlet 570 of the air conditioning system 562. It should be understood that if the air conditioning system 562 is not operating, the dry air provided by branch supply duct 592 continues to be fed to the guest stateroom 518 as it may flow through the air handler 542, supply duct 568, and exit the supply outlet 570, or it may flow into the enclosure 566 and out the return vent 564 used for the air conditioning system 562.

Two additional branch supply ducts 594 and 600 branch off from the branch supply duct 592 with the branch supply duct 594 feeding a supply outlet 596 positioned in the crew quarters 526. Similarly, the branch supply duct 600 feeds a supply outlet 598 positioned in the salon 530.

In the illustrative embodiment, the dehumidification system 580 includes an additional return inlet 588 positioned in the crew quarters 526. The return inlet 588 is connected to a return duct 590 that connects directly to the dehumidifier 584 so that the return air is fed directly to the dehumidifier 584.

While the enclosed space 512 is generally air-tight, the compartments 516, 518, 526, and 530 permit some cross-flow and the doors 522, 524, and 528 are left open during a majority of the time so that air may flow between the various compartments 516, 518, 526, and 530. Because of this ability of air to move between the compartments 516, 518, 526, and 530, the use of the return inlet 586 and return inlet 588 to feed air back to the dehumidifier 584 is sufficient to permit the air to flow throughout the enclosed space 512 and provide sufficient dehumidification of the air in the enclosed space 512 by dispersing the various supply outlets 570, 570, 596, and 598 throughout the compartments 516, 518, 526, and 530.

In each of the variants of supplying dehumidified air described above, the dehumidification system 580 is independent of any air conditioning system and the dry air is fed to the respective air conditioning systems so that the air conditioning systems are processing dry air.

The dehumidification system 580 includes a drain 602 which transfers water removed by the dehumidifier 584 through the hull 12 and overboard. In some embodiments, the drain 602 is not directed to discharge the water overboard, but may be discharged into a sump or a gray water tank and re-used for other uses that do not require potable water on board the vessel 510. When the water is discharged to a sump, a separate sump pump may be used to occasionally discharge the water overboard. The dehumidification system 580 is connected to a controller 80 as discussed above. The controller 80 includes the humidity sensor and is positioned in the interior of the main stateroom 516 in the illustrative embodiment, but is spaced apart from the supply 570. In practice, it has been determined that the air within the interior space 512 mixes sufficiently such that the location of the controller 80 provides an accurate assessment of the humidity of the air throughout the interior space 512. However, in other embodiments, the controller 80 and/or sensor may be positioned in other locations to better assess the humidity in the interior space 512. In some embodiments, multiple sensors 80 may be positioned throughout the interior space 512 and the controller 80 may use logic to determine when to operation the dehumidification system 580 based on the readings of more than one sensor.

In one illustrative embodiment, the dehumidifier 42 is an Ultra-Aire™ 70H dehumidifier available from Therma-Stor LLC of Madison, Wis. The Ultra-Aire™ Control Part No. 4028539 also available from Therma-Stor LLC of Maidson, Wis. is a suitable controller that may be used as the dehumidification controller 80. It has been found that for installations where the total ducting is less than twenty-five (25) feet, return ducting and grilles must have at least fifty (50) square inches of cross-section. For ducts lengths of greater than twenty-five (25) feet, but less than fifty (50) feet, return ducting and grilles must have at least seventy-five (75) square inches of cross-section.

Through experimentation, it has been determined that the use of a separate, dedicated, dehumidification system reduces the load on the air conditioning system and permits a higher set-point temperature to be used to reach an acceptable level of comfort. It has also been observed that the reduction in moisture, down to 40% relative humidity, even up to temperatures of seventy-seven degrees Fahrenheit, tends to provide sufficient comfort for many users. In addition, it has been found that the reduction in humidity reduces the amount of odors experienced in the internal space of a marine vessel. This reduction in odors is believed to be a result of the reduction of amount of moisture available to carry volatiles that evaporate from fuel storage structure on the vessel. The reduction in moisture also reduces the potential for mold spores to colonize by reducing the amount of moisture that condenses on the cold surfaces of the vessel, including the surface of supply outlet such as grates, for example.

It should also be noted that the enclosed interior of marine vessels tend to have high concentrations of formaldehyde. It has been determined experimentally that the level of formaldehyde in the air is reduced substantially by use of an independent dehumidification system. In one embodiment, testing showed that the level of formaldehyde was reduced from 60 parts per billion when the independent dehumidification system was not active to 52 parts per billion when the independent dehumidification system was activated and the relative humidity with a relative humidity set point of 50%. The removal of humidity is believed to reduce the presence of formaldehyde because of the attraction of the formaldehyde molecules to the water in the air. Both formaldehyde and water are polar molecules and there is a natural attraction of their dipoles. As the water is removed from the air by the dehumidification system, the formaldehyde which is attracted to, and in some cases, dissolved in the water in the air, the formaldehyde molecules are carried out of the interior spaces by the removal of the water. As described above, the occasional in-rush of humid air into the interior spaces through opened hatches will tend to cause a temporary increase in humidity in the interior space which will subsequently be removed by the independent dehumidification system. This increase in humidity will attract and remove additional formaldehyde molecules.

Formaldehyde is known to be continuously produced by various building materials used in the construction of marine vessels such as marine vessel 10. While formaldehyde tends to decompose in open space and under sunlight, the enclosed spaces that are present in marine vessels tend to limit the opportunity for decomposition of formaldehyde, thereby increasing the concentration. In addition, the presence of humidity tends to draw the formaldehyde from the building materials into the humid air. It has been found that the operation of the independent dehumidification systems disclosed herein reduce the concentration of formaldehyde in the air. For example, the results of a first test are presented in Table 1 below. This test was conducted in the enclosed space of a Viking® 66 foot long marine vessel. The readings were taken in a main cabin of the vessel. The test was conducted with the dehumidification system in an off condition and then subsequently turned on with measurements being taken after the dehumidification system was turned on as reflected at sample 2. The temperature, relative humidity, and concentration of formaldehyde were each measured at various points in time. It can be seen that the reduction in formaldehyde concentration is correlated to the reduction in humidity. Table 2 presents the results of a second test that was conducted on a Viking® 61 foot vessel. The test associated with Table 2 was conducted with the dehumidification system operating at steady state and was subsequently turned off at sample 46. As can be seen from sample 47 and beyond, the concentration of formaldehyde rose in the enclosed space. The data supports a conclusion that maintenance of a reduced relative humidity level tends to reduce the concentration of formaldehyde, but the correlation between relative humidity and concentrations of formaldehyde is not as strong when the humidity level is not being actively controlled.

TABLE 1

| Sample | Time | Formaldehyde ppb | Temperature ° F. | Relative Humidity % RH |
|---|---|---|---|---|
| 1 | 12:41 PM | 70 | 65.3 | 58.3 |
| 2 | 7:02 PM | 50 | 67.1 | 43.1 |
| 3 | 7:32 PM | 46 | 67.1 | 42.7 |
| 4 | 8:02 PM | 45 | 66.2 | 42.3 |
| 5 | 8:32 PM | 43 | 66.2 | 42.8 |
| 6 | 9:02 PM | 41 | 66.2 | 41.9 |
| 7 | 9:32 PM | 41 | 66.2 | 42.0 |
| 8 | 10:02 PM | 39 | 66.2 | 41.9 |
| 9 | 10:32 PM | 37 | 66.2 | 41.7 |
| 10 | 11:02 PM | 39 | 66.2 | 41.1 |
| 11 | 11:32 PM | 39 | 66.2 | 42.3 |
| 12 | 12:02 AM | 41 | 66.2 | 41.7 |
| 13 | 12:32 AM | 38 | 65.3 | 42.1 |
| 14 | 1:02 AM | 41 | 65.3 | 42.2 |
| 15 | 1:32 AM | 38 | 65.3 | 41.7 |
| 16 | 2:02 AM | 39 | 65.3 | 41.7 |
| 17 | 2:32 AM | 40 | 64.4 | 42.2 |
| 18 | 3:02 AM | 40 | 64.4 | 42.0 |
| 19 | 3:32 AM | 39 | 64.4 | 41.8 |
| 20 | 4:02 AM | 39 | 64.4 | 41.5 |
| 21 | 4:32 AM | 38 | 63.5 | 41.7 |
| 22 | 5:02 AM | 38 | 63.5 | 41.7 |
| 23 | 5:32 AM | 38 | 63.5 | 41.5 |
| 24 | 6:02 AM | 39 | 63.5 | 41.1 |
| 25 | 6:32 AM | 38 | 63.5 | 41.1 |
| 26 | 7:02 AM | 39 | 62.6 | 41.1 |
| 27 | 7:32 AM | 37 | 62.6 | 41.1 |

TABLE 1-continued

| Sample | Time | Formaldehyde ppb | Temperature ° F. | Relative Humidity % RH |
|---|---|---|---|---|
| 28 | 8:02 AM | 39 | 62.6 | 41.2 |
| 29 | 8:32 AM | 38 | 62.6 | 40.8 |
| 30 | 9:02 AM | 37 | 62.6 | 40.8 |
| 31 | 9:32 AM | 35 | 62.6 | 40.8 |
| 32 | 10:02 AM | 32 | 62.6 | 40.6 |
| 33 | 10:32 AM | 33 | 62.6 | 40.6 |
| 34 | 11:02 AM | 33 | 63.5 | 40.7 |
| 35 | 11:32 AM | 34 | 63.5 | 41.7 |
| 36 | 12:02 PM | 34 | 63.5 | 42.6 |
| 37 | 12:32 PM | 32 | 63.5 | 41.7 |
| 38 | 1:02 PM | 33 | 63.5 | 42.5 |
| 39 | 1:32 PM | 35 | 63.5 | 42.4 |
| 40 | 2:02 PM | 36 | 63.5 | 42.2 |

TABLE 2

| Sample | Time | Formaldehyde ppb | Temperature ° F. | Relative Humidity % RH |
|---|---|---|---|---|
| 1 | 5:09 PM | 49 | 74.3 | 48.5 |
| 2 | 5:39 PM | 48 | 74.3 | 48.7 |
| 3 | 6:09 PM | 48 | 74.3 | 49.1 |
| 4 | 6:39 PM | 49 | 74.3 | 49.7 |
| 5 | 7:09 PM | 50 | 74.3 | 48.9 |
| 6 | 7:39 PM | 50 | 73.4 | 48.5 |
| 7 | 8:09 PM | 48 | 74.3 | 47.9 |
| 8 | 8:39 PM | 51 | 74.3 | 49.6 |
| 9 | 9:09 PM | 51 | 73.4 | 49.1 |
| 10 | 9:39 PM | 49 | 74.3 | 47.7 |
| 11 | 10:09 PM | 51 | 73.4 | 49.6 |
| 12 | 10:39 PM | 51 | 73.4 | 48.4 |
| 13 | 11:09 PM | 50 | 73.4 | 49.4 |
| 14 | 11:39 PM | 52 | 73.4 | 48.1 |
| 15 | 12:09 AM | 50 | 73.4 | 48.9 |
| 16 | 12:39 AM | 48 | 74.3 | 49.2 |
| 17 | 1:09 AM | 51 | 74.3 | 48.5 |
| 18 | 1:39 AM | 51 | 74.3 | 49.5 |
| 19 | 2:09 AM | 55 | 74.3 | 48.7 |
| 20 | 2:39 AM | 51 | 73.4 | 48.1 |
| 21 | 3:09 AM | 50 | 74.3 | 49.8 |
| 22 | 3:39 AM | 56 | 73.4 | 48.9 |
| 23 | 4:09 AM | 51 | 73.4 | 49.3 |
| 24 | 4:39 AM | 54 | 73.4 | 49.5 |
| 25 | 5:09 AM | 51 | 73.4 | 50.9 |
| 26 | 5:39 AM | 53 | 73.4 | 50.2 |
| 27 | 6:09 AM | 53 | 73.4 | 51.0 |
| 28 | 6:39 AM | 53 | 73.4 | 49.7 |
| 29 | 7:09 AM | 53 | 73.4 | 50.9 |
| 30 | 7:39 AM | 54 | 73.4 | 49.9 |
| 31 | 8:09 AM | 53 | 73.4 | 50.1 |
| 32 | 8:39 AM | 51 | 73.4 | 50.6 |
| 33 | 9:09 AM | 50 | 73.4 | 49.9 |
| 34 | 9:39 AM | 50 | 74.3 | 49.9 |
| 35 | 10:09 AM | 51 | 74.3 | 49.3 |
| 36 | 10:39 AM | 57 | 74.3 | 48.0 |
| 37 | 11:09 AM | 54 | 74.3 | 49.4 |
| 38 | 11:39 AM | 56 | 74.3 | 48.9 |
| 39 | 12:09 PM | 55 | 74.3 | 47.5 |
| 40 | 12:39 PM | 53 | 74.3 | 46.1 |
| 41 | 1:09 PM | 54 | 74.3 | 48.5 |
| 42 | 1:39 PM | 54 | 74.3 | 47.9 |
| 43 | 2:09 PM | 51 | 74.3 | 46.6 |
| 44 | 2:39 PM | 54 | 74.3 | 46.5 |
| 45 | 3:09 PM | 53 | 74.3 | 48.1 |
| 46 | 3:39 PM | 55 | 74.3 | 48.4 |
| 47 | 4:09 PM | 52 | 74.3 | 55.0 |
| 48 | 4:39 PM | 45 | 74.3 | 58.1 |
| 49 | 5:09 PM | 57 | 74.3 | 53.8 |
| 50 | 5:39 PM | 57 | 73.4 | 58.2 |
| 51 | 6:09 PM | 55 | 74.3 | 56.1 |
| 52 | 6:39 PM | 63 | 73.4 | 59.2 |
| 53 | 7:09 PM | 55 | 74.3 | 58.4 |

TABLE 2-continued

| Sample | Time | Formaldehyde ppb | Temperature ° F. | Relative Humidity % RH |
|---|---|---|---|---|
| 54 | 7:39 PM | 59 | 74.3 | 58.2 |
| 55 | 8:09 PM | 68 | 73.4 | 59.2 |
| 56 | 8:39 PM | 58 | 73.4 | 59.7 |
| 57 | 9:09 PM | 58 | 73.4 | 59.5 |
| 58 | 9:39 PM | 62 | 73.4 | 59.7 |
| 59 | 10:09 PM | 60 | 74.3 | 59.4 |
| 60 | 10:39 PM | 63 | 73.4 | 59.7 |
| 61 | 11:09 PM | 62 | 73.4 | 59.8 |
| 62 | 11:39 PM | 62 | 73.4 | 60.0 |
| 63 | 12:09 AM | 62 | 73.4 | 60.2 |
| 64 | 12:39 AM | 63 | 73.4 | 60.2 |
| 65 | 1:09 AM | 61 | 73.4 | 60.3 |
| 66 | 1:39 AM | 62 | 73.4 | 60.5 |
| 67 | 2:09 AM | 62 | 73.4 | 60.3 |
| 68 | 2:39 AM | 62 | 73.4 | 60.5 |
| 69 | 3:09 AM | 62 | 72.5 | 60.8 |
| 70 | 3:39 AM | 61 | 72.5 | 60.8 |
| 71 | 4:09 AM | 61 | 72.5 | 61.0 |
| 72 | 4:39 AM | 62 | 72.5 | 61.0 |
| 73 | 5:09 AM | 61 | 72.5 | 61.0 |
| 74 | 5:39 AM | 61 | 72.5 | 61.2 |
| 75 | 6:09 AM | 60 | 72.5 | 61.3 |
| 76 | 6:39 AM | 61 | 71.6 | 61.6 |
| 77 | 7:09 AM | 60 | 71.6 | 61.6 |
| 78 | 7:39 AM | 61 | 71.6 | 61.6 |
| 79 | 8:09 AM | 60 | 71.6 | 61.7 |
| 80 | 8:39 AM | 58 | 71.6 | 62.1 |
| 81 | 9:09 AM | 56 | 71.6 | 62.7 |
| 82 | 9:39 AM | 56 | 71.6 | 62.9 |
| 83 | 10:09 AM | 54 | 72.5 | 63.0 |
| 84 | 10:39 AM | 55 | 72.5 | 63.4 |
| 85 | 11:09 AM | 55 | 72.5 | 63.7 |
| 86 | 11:39 AM | 56 | 73.4 | 63.6 |
| 87 | 12:09 PM | 55 | 73.4 | 63.4 |
| 88 | 12:39 PM | 56 | 74.3 | 63.1 |
| 89 | 1:09 PM | 71 | 73.4 | 61.3 |
| 90 | 1:39 PM | 56 | 73.4 | 63.9 |
| 91 | 2:09 PM | 68 | 73.4 | 65.2 |
| 92 | 2:39 PM | 63 | 73.4 | 60.5 |
| 93 | 3:09 PM | 57 | 74.3 | 64.8 |
| 94 | 3:39 PM | 70 | 73.4 | 65.4 |

The dehumidification systems of the present disclosure are suitable for retrofitting a marine vessel to upgrade the vessel to include the independent reunification system. To implement the dehumidification system, an installer, after having determined the appropriate size of dehumidification system, installs the dehumidifier 42. In many cases, the dehumidifier 42 is within a bulkhead, such as bulkheads 70, 72, or 74. On larger vessels, such as recreational vessels in excess of fifty (50) feet in overall length, there is sufficient space between interior walls and the whole, or between surfaces of the bulkhead, permit the dehumidifier 42 to be positioned out of sight. The installer then determines the appropriate locations for each of the supply grates. The installer may then install appropriate ductwork behind any walls or within any bulkheads to route the ductwork between the dehumidifier 42 and any supply outlets, such as supply outlets 62, 66, or 68. The installer must also identify the appropriate location of the return register 60, install the return register 60, and install any return ductwork, such as return duct 58. Once the location of each of the supply outlets 62, 66, and 68 are determined, along with the return register 60, the installer may determine the appropriate location for the dehumidification controller 80 and install it, routing the appropriate electrical connections between the dehumidification controller 80 and the dehumidifier 42. The dehumidifier 42 is connected to an appropriate power source from the vessel 10 and tested as necessary to confirm appropriate airflow is occurring between the various components of the dehumidification system 40.

While the present disclosure is presented relative to marine vessels, it should be understood that the teachings may be equally applicable to other enclosed spaces that are subject to high humidity climates. For example, it is contemplated that the independent dehumidification system disclosed herein may provide similar benefits in recreational vehicles or manufactured/temporary housing units. Centralized dehumidification independent of HVAC systems has the ability to better control the environment in the enclosed spaces as well as reducing volatiles.

Although the invention has been described with reference to the preferred embodiments, variations and modifications exist within the scope and spirit of the invention as described and defined in the following claims.

The invention claimed is:

1. A marine vessel comprising an interior cabin space which is independent of untreated ambient atmospheric air, the interior cabin space including at least two compartments, at least one cabin door that is selectively openable to permit a transfer of the untreated ambient atmospheric air into the interior cabin space and configured to permit an entry and exit of a person into and out of the interior cabin space, an air-conditioning system having an air handler, a supply outlet, a return inlet, and a dedicated air conditioning system ductwork between the supply outlet, the return inlet, and the air handler, and a dehumidification system having a first supply outlet positioned in a first compartment of the cabin space, a second supply outlet positioned in a second compartment of the cabin space, a first return inlet spaced apart from at least one of the first and second compartments, a dehumidifier which draws air from the first return inlet, removes moisture from the air, and discharges the air having reduced moisture to the first and second supply outlets, the dehumidifier positioned in a separate enclosure separating the dehumidifier from the first and second compartments, and a controller operable to detect the relative humidity in the cabin space and to control operation of the dehumidifier to cause a dehumidifier to discharge air having reduced moisture to the supply outlets when the relative humidity exceeds a predetermined threshold.

2. The marine vessel of claim 1, further comprising a third supply outlet positioned in a third compartment.

3. The marine vessel of claim 1, wherein a portion of the air supplied by the dehumidifier is directed directly to the air handler of the air conditioning system and directed through a supply duct of the air conditioning system directing a flow of supply air from the air handler of the air conditioning system to a supply outlet of the air conditioning system.

4. The marine vessel of claim 1, wherein at least one of the compartments includes a door that is movable between an open position allowing air to flow between the compartment and the remainder of the cabin space and a closed position.

5. The marine vessel of claim 4, wherein a portion of the air supplied by the dehumidifier is directed directly to the air handler of the air conditioning system and directed through a supply duct of the air conditioning system directing a flow of supply air from the air handler of the air conditioning system to a supply outlet of the air conditioning system.

6. A marine vessel comprising an interior cabin space which is independent of untreated ambient atmospheric air, the interior cabin space including at least two compartments, at least one cabin door that is selectively openable to permit a transfer of the untreated ambient atmospheric air into the interior cabin space and configured to permit an entry and exit of a person into and out of the interior cabin space, an air-conditioning system having an air handler, a supply outlet, a return inlet, and a dedicated air conditioning system ductwork between the supply outlet, the return inlet, and the air handler, and a dehumidification system having a first supply outlet positioned in a first compartment of the cabin space, a second supply outlet positioned in a second compartment of the cabin space, a first return inlet spaced apart from at least one of the first and second compartments, a dehumidifier which draws air from the first return inlet, removes moisture from the air, and discharges the air having reduced moisture to the first and second supply outlets, the dehumidifier positioned in a separate enclosure separating the dehumidifier from the first and second compartments, and a controller operable to detect the relative humidity in the cabin space and to control operation of the dehumidifier to cause a dehumidifier to discharge air having reduced moisture to the supply outlets when the relative humidity exceeds a predetermined threshold, wherein the marine vessel further comprises a third supply outlet positioned in a third compartment, and wherein the enclosure separating the dehumidifier from the first and second compartments is formed to include second return inlet positioned on a wall of the enclosure to allow air to feed through the second return inlet into the enclosure and provide return air to the dehumidifier.

7. The marine vessel of claim 6, wherein at least one of the compartments includes a door that is movable between an open position allowing air to flow between the compartment and the remainder of the cabin space and a closed position.

8. The marine vessel of claim 7, wherein a portion of the air supplied by the dehumidifier is directed directly to the air handler of the air conditioning system and directed through a supply duct of the air conditioning system directing a flow of supply air from the air handler of the air conditioning system to a supply outlet of the air conditioning system.

9. A marine vessel comprising an interior cabin space which is independent of untreated ambient atmospheric air, the interior cabin space including at least two compartments, at least one cabin door that is selectively openable to permit a transfer of the untreated ambient atmospheric air into the interior cabin space and configured to permit an entry and exit of a person into and out of the interior cabin space, an air-conditioning system having an air handler, a supply outlet, a return inlet, and a dedicated air conditioning system ductwork between the supply outlet, the return inlet, and the air handler, and a dehumidification system having a first supply outlet positioned in a first compartment of the cabin space, a second supply outlet positioned in a second compartment of the cabin space, a first return inlet spaced apart from at least one of the first and second compartments, a dehumidifier which draws air from the first return inlet, removes moisture from the air, and discharges the air having reduced moisture to the first and second supply outlets, the dehumidifier positioned in a separate enclosure separating the dehumidifier from the first and second compartments, and a controller operable to detect the relative humidity in the cabin space and to control operation of the dehumidifier to cause a dehumidifier to discharge air having reduced moisture to the supply outlets when the relative humidity exceeds a predetermined threshold, wherein the enclosure separating the dehumidifier from the first and second compartments is formed to include second return inlet positioned on a wall of the enclosure to allow air to feed through the second return inlet into the enclosure and provide return air to the dehumidifier.

10. The marine vessel of claim 9, wherein at least one of the compartments includes a door that is movable between an open position allowing air to flow between the compartment and the remainder of the cabin space and a closed position.

11. The marine vessel of claim 10, wherein a portion of the air supplied by the dehumidifier is directed directly to the air handler of the air conditioning system and directed through a supply duct of the air conditioning system directing a flow of supply air from the air handler of the air conditioning system to a supply outlet of the air conditioning system.

12. A marine vessel comprising an interior cabin space which is independent of untreated ambient atmospheric air, the interior cabin space including at least two compartments, at least one cabin door that is selectively openable to permit a transfer of the untreated ambient atmospheric air into the interior cabin space and configured to permit an entry and exit of a person into and out of the interior cabin space, an air-conditioning system having an air handler, a supply outlet, a return inlet, and a dedicated air conditioning system ductwork between the supply outlet, the return inlet, and the air handler, and a dehumidification system having a first supply outlet positioned in a first compartment of the cabin space, a second supply outlet positioned in a second compartment of the cabin space wherein a portion of the air supplied by the dehumidifier is directed directly to the air handler of the air conditioning system and directed through a supply duct of the air conditioning system directing a flow of supply air from the air handler of the air conditioning system to the second supply, a first return inlet spaced apart from at least one of the first and second compartments, a dehumidifier which draws air from the first return inlet, removes moisture from the air, and discharges the air having reduced moisture to the first and second supply outlets, the dehumidifier positioned in a separate enclosure separating the dehumidifier from the first and second compartments, and a controller operable to detect the relative humidity in the cabin space and to control operation of the dehumidifier to cause a dehumidifier to discharge air having reduced moisture to the supply outlets when the relative humidity exceeds a predetermined threshold.

13. The marine vessel of claim 12, further comprising a third supply outlet positioned in a third compartment.

14. The marine vessel of claim 12, wherein at least one of the compartments includes a door that is movable between an open position allowing air to flow between the compartment and the remainder of the cabin space and a closed position.

15. The marine vessel of claim 14, wherein the marine vessel includes a fourth cabin including a second air conditioning system positioned in an enclosure in the fourth cabin and wherein a portion of the air supplied by the dehumidifier is directed to the enclosure in the fourth cabin and an air handler of the second air conditioning system draws air into the air handler from within the enclosure in the fourth cabin and directed through a supply duct of the air conditioning system directing a flow of supply air from the air handler of the air conditioning system to a supply outlet of the air conditioning system.

16. A marine vessel comprising an interior cabin space which is independent of untreated ambient atmospheric air, the interior cabin space including at least two compartments, at least one cabin door that is selectively openable to permit a transfer of the untreated ambient atmospheric air into the interior cabin space and configured to permit an entry and exit of a person into and out of the interior cabin space, an air-conditioning system having an air handler, a supply outlet, a return inlet, and a dedicated air conditioning system ductwork between the supply outlet, the return inlet, and the air handler, and a dehumidification system having a first supply outlet positioned in a first compartment of the cabin space, a second supply outlet positioned in a second compartment of the cabin space wherein a portion of the air supplied by the dehumidifier is directed directly to the air handler of the air conditioning system and directed through a supply duct of the air conditioning system directing a flow of supply air from the air handler of the air conditioning system to the second supply, a first return inlet spaced apart from at least one of the first and second compartments, a dehumidifier which draws air from the first return inlet, removes moisture from the air, and discharges the air having reduced moisture to the first and second supply outlets, the dehumidifier positioned in a separate enclosure separating the dehumidifier from the first and second compartments, and a controller operable to detect the relative humidity in the cabin space and to control operation of the dehumidifier to cause a dehumidifier to discharge air having reduced moisture to the supply outlets when the relative humidity exceeds a predetermined threshold, wherein the marine vessel further comprises a third supply outlet positioned in a third compartment, and wherein the enclosure separating the dehumidifier from the first and second compartments is formed to include second return inlet positioned on a wall of the enclosure to allow air to feed through the second return inlet into the enclosure and provide return air to the dehumidifier.

17. The marine vessel of claim 16, wherein at least one of the compartments includes a door that is movable between an open position allowing air to flow between the compartment and the remainder of the cabin space and a closed position.

18. The marine vessel of claim 17, wherein the marine vessel includes a fourth cabin including a second air conditioning system positioned in an enclosure in the fourth cabin and wherein a portion of the air supplied by the dehumidifier is directed to the enclosure in the fourth cabin and an air handler of the second air conditioning system draws air into the air handler from within the enclosure in the fourth cabin and directed through a supply duct of the air conditioning system directing a flow of supply air from the air handler of the air conditioning system to a supply outlet of the air conditioning system.

19. A marine vessel comprising an interior cabin space which is independent of untreated ambient atmospheric air, the interior cabin space including at least two compartments, at least one cabin door that is selectively openable to permit a transfer of the untreated ambient atmospheric air into the interior cabin space and configured to permit an entry and exit of a person into and out of the interior cabin space, an air-conditioning system having an air handler, a supply outlet, a return inlet, and a dedicated air conditioning system ductwork between the supply outlet, the return inlet, and the air handler, and a dehumidification system having a first supply outlet positioned in a first compartment of the cabin space, a second supply outlet positioned in a second compartment of the cabin space wherein a portion of the air supplied by the dehumidifier is directed directly to the air handler of the air conditioning system and directed through a supply duct of the air conditioning system directing a flow of supply air from the air handler of the air conditioning system to the second supply, a first return inlet spaced apart from at least one of the first and second compartments, a dehumidifier which draws air from the first return inlet, removes moisture from the air, and discharges the air having reduced moisture to the first and second supply outlets, the dehumidifier positioned in a separate enclosure separating the dehumidifier from the first and second compartments, and a controller operable to detect the relative humidity in the cabin space and to control operation of the dehumidifier to cause a dehumidifier to discharge air having reduced moisture to the supply outlets when the relative humidity exceeds a predetermined threshold, wherein the enclosure separating the dehumidifier from the first and second compartments is formed to include second return inlet positioned on a wall of the enclosure to allow air to feed through the second return inlet into the enclosure and provide return air to the dehumidifier.

20. The marine vessel of claim 19, wherein at least one of the compartments includes a door that is movable between an open position allowing air to flow between the compartment and the remainder of the cabin space and a closed position.

21. The marine vessel of claim 20, wherein the marine vessel includes a fourth cabin including a second air conditioning system positioned in an enclosure in the fourth cabin and wherein a portion of the air supplied by the dehumidifier is directed to the enclosure in the fourth cabin and an air handler of the second air conditioning system draws air into the air handler from within the enclosure in the fourth cabin and directed through a supply duct of the air conditioning system directing a flow of supply air from the air handler of the air conditioning system to a supply outlet of the air conditioning system.

22. A marine vessel comprising an interior cabin space which is independent of untreated ambient atmospheric air, the interior cabin space including at least two compartments, at least one cabin door that is selectively openable to permit a transfer of the untreated ambient atmospheric air into the interior cabin space and configured to permit an entry and exit of a person into and out of the interior cabin space, an air-conditioning system having an air handler, a supply outlet, a return inlet, and a dedicated air conditioning system ductwork between the supply outlet, the return inlet, and the air handler, and a dehumidification system having a first supply outlet positioned in a first compartment of the cabin space, a second supply outlet positioned in a second compartment of the cabin space wherein a portion of the air supplied by the dehumidifier is directed directly to the air handler of the air conditioning system and directed through a supply duct of the air conditioning system directing a flow of supply air from the air handler of the air conditioning system to the second supply, a first return inlet spaced apart from at least one of the first and second compartments, a dehumidifier which draws air from the first return inlet, removes moisture from the air, and discharges the air having reduced moisture to the first and second supply outlets, the dehumidifier positioned in a separate enclosure separating the dehumidifier from the first and second compartments, and a controller operable to detect the relative humidity in the cabin space and to control operation of the dehumidifier to cause a dehumidifier to discharge air having reduced moisture to the supply outlets when the relative humidity exceeds a predetermined threshold, wherein the marine vessel includes a fourth cabin including a second air conditioning system positioned in an enclosure in the fourth cabin and wherein a portion of the air supplied by the dehumidifier is directed to the enclosure in the fourth cabin and an air handler of the second air conditioning system draws air into the air handler from within the enclosure in the fourth cabin and directed through a supply duct of the air conditioning system directing a flow of supply air from the air handler of the air conditioning system to a supply outlet of the air conditioning system.

* * * * *